US005356042A

United States Patent [19]

Huffman et al.

[11] Patent Number: 5,356,042

[45] **Date of Patent: * Oct. 18, 1994**

[54] CONTAINER HAVING A VALVE CONTROLLED OUTLET

[76] Inventors: Terry Huffman, 947 S. Oak St., Grand Island, Nebr. 68801; Aage Nost, 4428 Center St., Omaha, Nebr. 68105

[ * ] Notice: The portion of the term of this patent subsequent to Mar. 16, 2010 has been disclaimed.

[21] Appl. No.: 31,725

[22] Filed: Mar. 15, 1993

Related U.S. Application Data

[63] Continuation of Ser. No. 783,385, Oct. 28, 1991, Pat. No. 5,193,719.

[51] Int. Cl.[5] ..... B67D 3/00

[52] U.S. Cl. ..... 222/153; 222/510

[58] Field of Search ..... 222/153, 510, 518, 555, 222/568, 212, 213, 548

[56] References Cited

U.S. PATENT DOCUMENTS

| | | | |
|---|---|---|---|
| 1,043,656 | 11/1912 | Ziringer | 222/510 |
| 2,319,517 | 5/1943 | Rand | 222/510 X |
| 3,236,697 | 2/1966 | Amiet et al. | 222/81 X |
| 4,513,883 | 4/1985 | Melzi et al. | 222/510 X |
| 4,950,237 | 8/1990 | Henault et al. | 222/510 X |
| 4,973,183 | 11/1990 | Shevick et al. | 222/510 X |
| 5,123,570 | 6/1992 | Dubow et al. | 222/510 X |
| 5,193,719 | 3/1993 | Huffman et al. | 222/510 X |

FOREIGN PATENT DOCUMENTS

| | | | |
|---|---|---|---|
| 641444 | 6/1962 | Italy | 222/518 |

*Primary Examiner*—Kevin P. Shaver
*Attorney, Agent, or Firm*—H. Jay Spiegel

[57] ABSTRACT

A dispensing container for motor oil includes a conventional oil container which has an upwardly tapered top surface. A valve at the outlet and a valve stem is axially disposed in the container. The valve and valve stem have a bellowed actuating member disposed in an open cavity at the container bottom, which when depressed, opens the valve. A safety stem is provided on the valve stem which engages the tapered top surface for preventing the valve and valve stem from falling out of the container after the container has been opened and inverted.

7 Claims, 3 Drawing Sheets

CONTAINER HAVING A VALVE CONTROLLED OUTLET

This application is a continuation of application Ser. No. 07/783,385, filed Oct. 28, 1991, now U.S. Pat. No. 5,193,719.

BACKGROUND

It has become customary for motorists to purchase containers of motor oil in singular numbers, and maintain proper oil level in the crank case by adding oil when necessary. If it were necessary to add oil when no funnel or other tools were available, it was common to spill oil on the motor, or on your hands. In accordance with the present invention, we are able to avoid this spilling, since after removing the threadably engaged closure cap, the secondary closure will prevent oil from escaping the container while it is being turned upside down, and placed in the oil filler opening of the engine. The oil will only flow into the engine after the secondary closure is opened, thus preventing the chance of any hazardous and unwanted spill. Funnels or other tools will not be needed to dispense oil into the motor.

SUMMARY

The present invention relates to a new and spill proof way of dispensing oil and other liquids using a conventional shaped container, and further using a threadably engaged closure cap about the container opening, a secondary closure under the cap, functioning as a plug shaped valve head attached to a push rod extending from the top to the bottom of the container. This valve can be extended out of the opening, thereby allowing for free flow of the liquids from the container, or by having a twist top container neck with slated openings inside, so when the slats are aligned, the fluid will flow from the container.

DESCRIPTION OF THE PREFERRED EMBODIMENT

Figure 1:
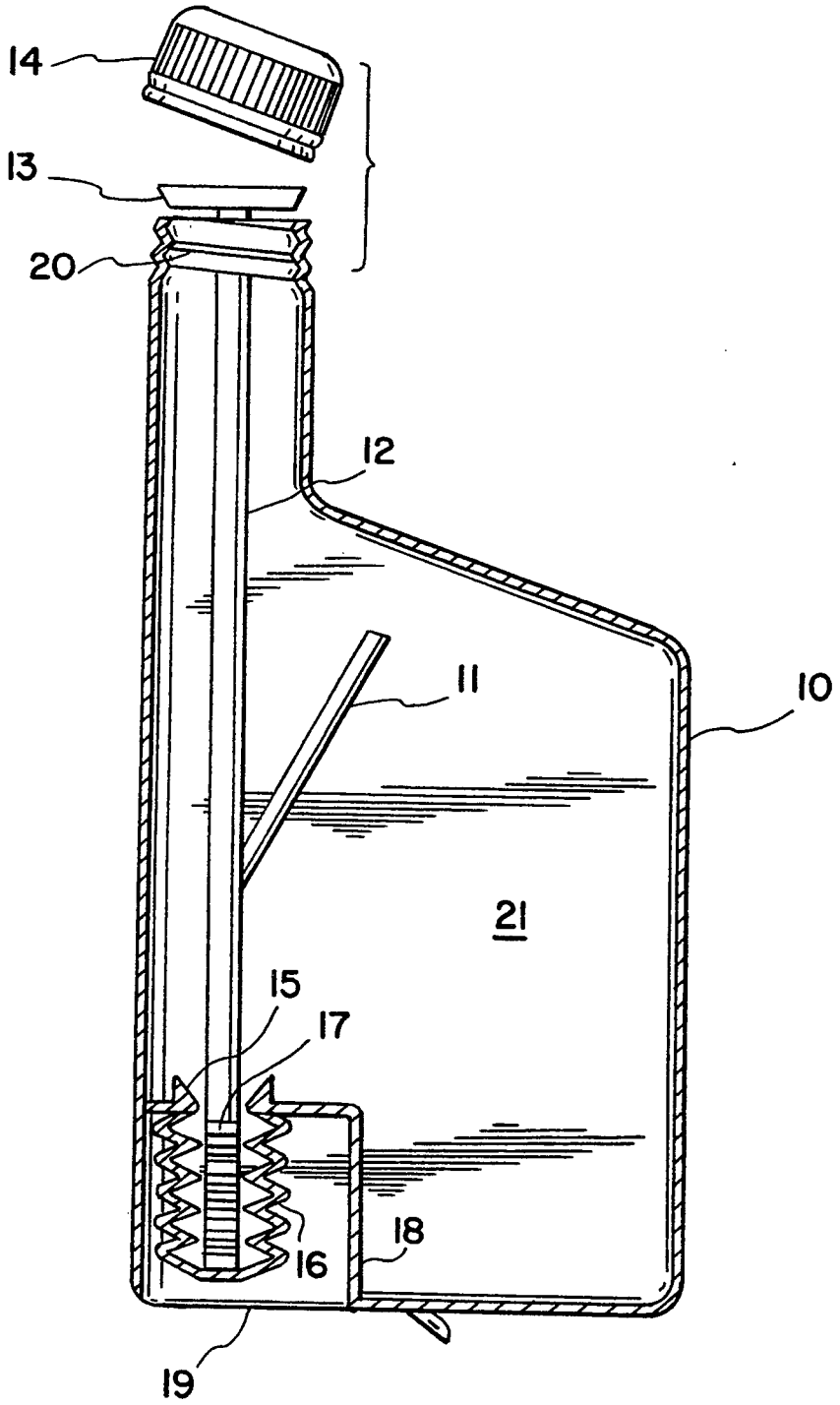
FIG. 1 is a full cut-a-way vertical side view of a first embodiment in which the internal hull of the container is exposed.
Figure 2:
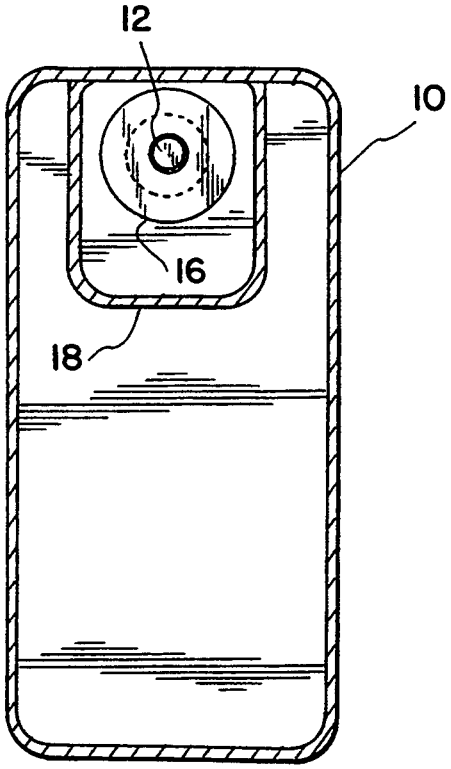
FIG. 2 is a bottom view of the container of FIG. 1.

In accordance with the preferred embodiment of the present invention, attention being directed to FIG. 1 and FIG. 2 of the drawings, the container generally designated 10 has the shape of a conventional oil container with an upwardly tapered top surface. Element 11 is a safety stem attached to valve stem 12, and helps to prevent the valve stem 12 from falling out when pouring oil from the container by its engagement with the internal side of the upwardly tapered top surface of the container. Element 13 is a closure plug shaped valve head mounted on valve stem 12 that opens up the container outlet. Element 14 is a closure cap adapted to be threadably engaged about the top. Specifically, the threaded engagement is provided by means of threads 20 formed about the periphery of the top of the neck of the container, and the closure cap 14 being provided with internal matching threads. The internal bottom surface of the container adjacent valve stem 12 has an opening with a tapered guide 15, to assist in the insertion of the valve stem 12 into the accordion type bellows 16. Bellows 16 can be depressed so the valve stem 12 will push the valve plug 13 out and opens up the container outlet for the free flow of oil. Grooves 17 are provided on valve stem 12, to hold the valve stem in place by the inside edges of the accordion type bellows 16, acting as a back up safety feature to prevent the valve stem and the valve plug 13 from falling out if by accident the safety stem 11 was missing. The whole assembly of the valve plug 13, valve stem 12, safety stem 11, and accordion type bellows 16 is made of a flexible plastic, otherwise it cannot be inserted into the container, or manipulated to open up the valve. Wall 18 at the container bottom creates a cavity in which the accordion type bellows 16 are housed and protected from damage. A plastic seal 19 with pull tab is glued onto the bottom of the container 10 to cover up the cavity. The term "conventional oil container" in the initial description of the shape of the container may be used in a comprehensive sense, and is intended to encompass containers having round or circular walls, as well as those with plainer panels and rectangular, cylindrical configurations.

DESCRIPTION OF ALTERNATE PREFERRED EMBODIMENT

Figure 5:
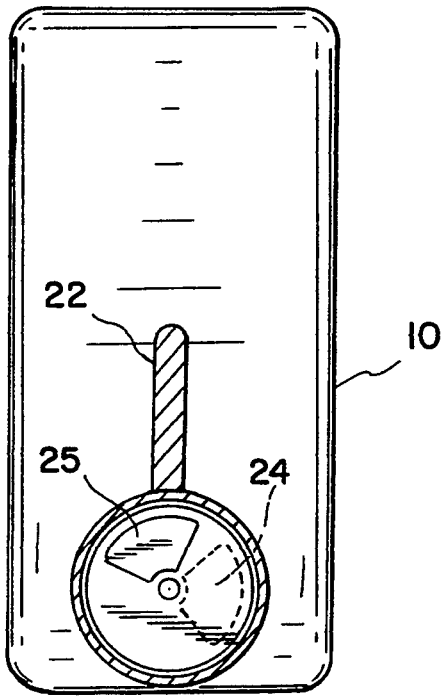
FIG. 5 is a top view of FIG. 3, showing the internal opening, or slats, of the twist top container neck, and showing how the quadrant shape openings can be twisted into position to open and close by aligning the two openings so a through passage from the bottom of the container through the neck is opened up.
Figure 3:
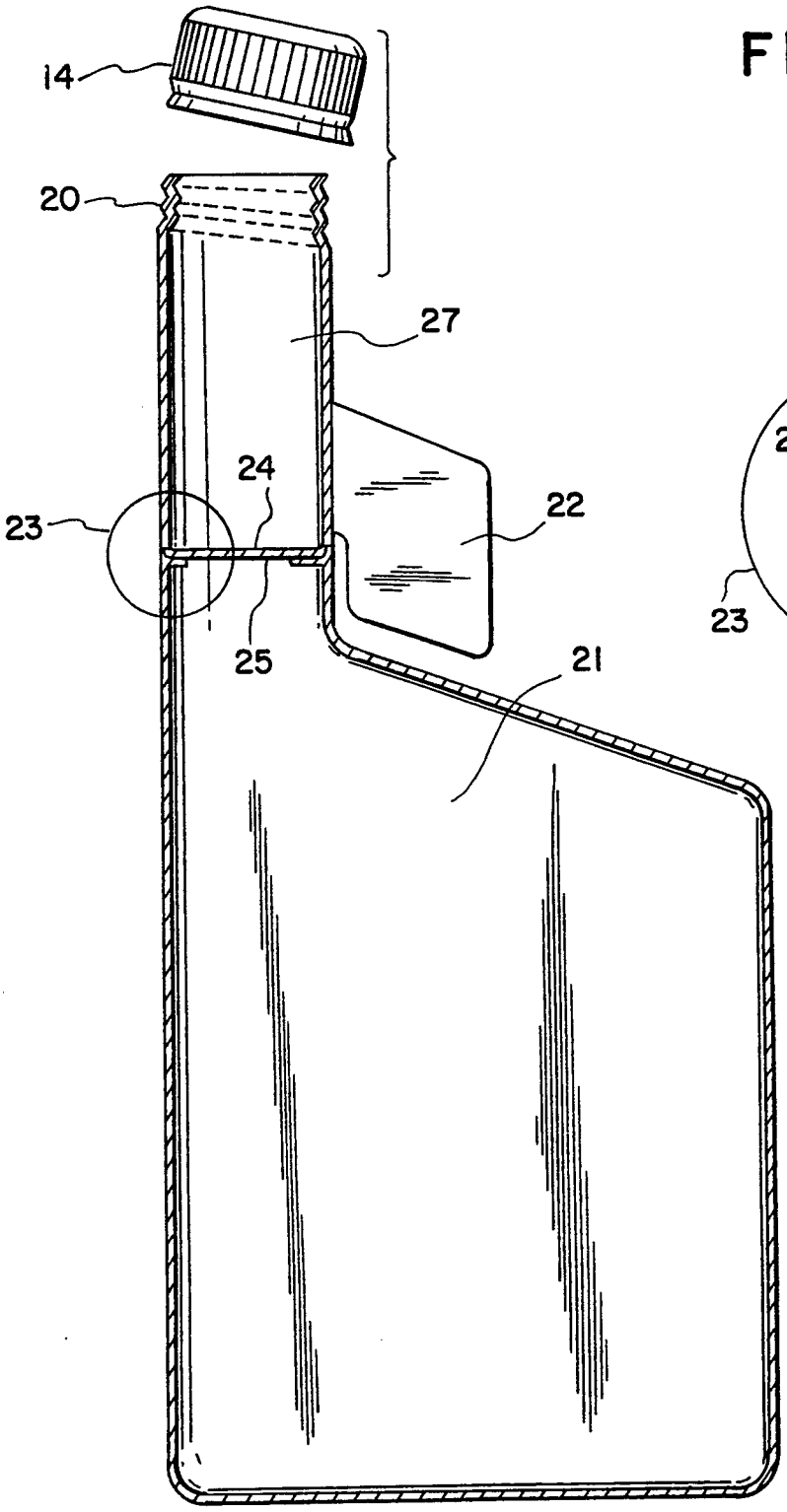
FIG. 3 is a full cut-a-way vertical side view of a second embodiment in which the internal hull of the container is exposed, showing two sections of the container, and where they are connected.
Figure 4:
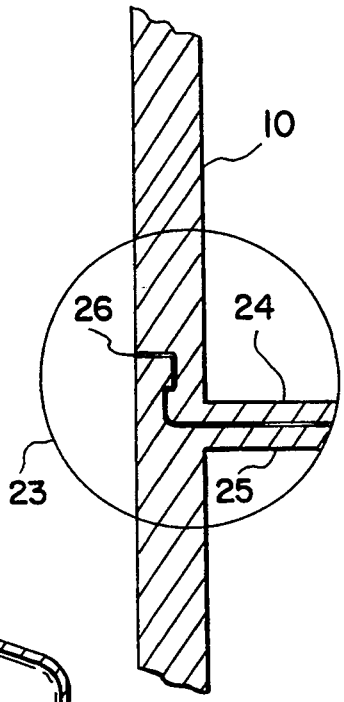
FIG. 4 is an enlarged, fragmented, vertical sectional view taken from the view of FIG. 3, as indicated by the circle, showing how the two sections are connected.

Attention is now being directed to FIG. 3, 4, and 5, where we can see that the container 10, which has similar shape to that of FIG. 1, is provided with a slightly longer neck, 27, and a different valve as a secondary closure container shown in FIG. 1. The hull of the container 21 is filled with oil, and the oil is held in place by a closure cap 14, and a secondary valve 24, 25. The container will remain closed until the closure cap 14, and the secondary closure valve 24, 25 are opened. The secondary closure valve 24, 25 can be opened by twisting the handle 22, which is attached to the neck, 27. By that, the neck 27 creates an opening through which oil can freely flow out of the container. FIG. 4 shows a large, fragmented circle 23 which within, depicts how the portion 27 is snapped onto the main container 10, and creates a tight fit seal, 26, between the two component parts. One side, or a portion of the oil escapes the container by monitoring the fluid level in the container. By monitoring the fluid level in the container 21, the flow of oil from the container can be stopped after dispensing a desired amount, ½, ¼, etc., by twisting the handle 22, so the swivel neck turns and closes the valve 24, 25 by altering the position of the openings 24, 25 so they no longer are aligned, and thereby closing off the passage for free flow of oil from the hull of the container, 21. Having fully described this invention, I hereby reserve the benefit of all changes in form, arrangement, order, or use of all parts and materials, as it is obvious that many minor changes may be made to the design and arrangement of the individual component parts, without departing from the spirit of the invention.

We claim:

1. A dispenser for dispensing liquids, comprising:

a) a container having an outlet opening;

b) a valve stem disposed in said container, said valve stem at a first end, having a valve which normally closes said outlet opening and at a second end, being connected to the container;

c) means for flexibly connecting said second end to the container at a location remote from said outlet opening and having interior portions thereof which hold said second end of said valve stem, said flexibly connecting means serving as an actuator, when moved, for moving said valve via said valve stem, to a position in which the outlet opening is unobstructed by said valve to permit dispensing from the container; and d) means for preventing said valve and valve stem from falling out of the container after the container has been opened and inverted, said means comprising a safety stem angularly disposed on said valve stem in a direction toward a wall adjacent said outlet opening, said stem being spaced from said wall when the valve is in a closed position, whereupon moving the valve toward an open position causes the safety stem to move toward and eventually engage said wall thereby preventing said valve and stem from falling out of the container when the container is inverted.

2. The dispenser of claim 1, wherein said second end of said valve stem is located within a recess in said container, said recess being outwardly open at an access opening.

3. The dispenser according to claim 2, further comprising a seal disposed over said access opening.

4. The dispenser according to claim 3, further comprising a pull tab on said seal.

5. The dispenser of claim 1, wherein said means for flexibly connecting said second end of said valve stem to said container comprises a bellows formed at said location.

6. The dispenser according to claim 5, further comprising grooves on said second end of said valve stem which are engaged by interior portions of said bellows.

7. The dispenser according to claim 1, further comprising a threaded cap and threads surrounding said outlet opening to receive said cap.

* * * * *